US011490650B2

(12) United States Patent
Sebastian et al.

(10) Patent No.: US 11,490,650 B2
(45) Date of Patent: Nov. 8, 2022

(54) COMPOSITE TOBACCO-CONTAINING MATERIALS

(71) Applicant: R.J. Reynolds Tobacco Company, Winston-Salem, NC (US)

(72) Inventors: Andries D. Sebastian, Winston-Salem, NC (US); Bruce Bengtsson, Winston-Salem, NC (US); Jason Kobisky, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 38 days.

(21) Appl. No.: 16/806,782

(22) Filed: Mar. 2, 2020

(65) Prior Publication Data

US 2020/0196654 A1 Jun. 25, 2020

Related U.S. Application Data

(62) Division of application No. 13/530,145, filed on Jun. 22, 2012, now abandoned.

(51) Int. Cl.
*A24B 15/18* (2006.01)
*A24B 13/00* (2006.01)

(52) U.S. Cl.
CPC ..... *A24B 15/18* (2013.01); *A24B 13/00* (2013.01); *A24B 15/186* (2013.01)

(58) Field of Classification Search
None
See application file for complete search history.

(56) References Cited

U.S. PATENT DOCUMENTS 1,376,586 A 5/1921 Schwartz
3,318,748 A * 5/1967 Hurst ..... B32B 27/00 156/224
3,368,567 A 2/1968 Speer
(Continued)

FOREIGN PATENT DOCUMENTS

CN 101262786 9/2008
WO WO 2004/095959 11/2004
(Continued)

OTHER PUBLICATIONS

International Search Report for International Application No. PCT/US2013/047038 dated Oct. 24, 2013.

*Primary Examiner* — Phu H Nguyen
(74) *Attorney, Agent, or Firm* — Womble Bond Dickinson (US) LLP

(57) ABSTRACT

Tobacco products suitable for oral ingestion are provided. The tobacco products include a tobacco composition and at least one edible film. The edible film can include one or more of (i) a fruit or vegetable puree and (ii) a denatured protein. A multi-layer tobacco product is provided that includes a tobacco composition in the form of a compressed sheet layer and at least one edible film adjacent to the tobacco composition layer, wherein the edible film includes a puree of at least one fruit, vegetable, or a combination thereof. A process for preparing a tobacco product is also provided, such as a process that includes receiving a tobacco composition and an edible film; applying the edible film to the tobacco composition; and compressing the edible film and tobacco composition together to form a multi-layer tobacco product.

23 Claims, 4 Drawing Sheets

(56) References Cited

U.S. PATENT DOCUMENTS 3,528,434 A 9/1970 Halter et al.
3,696,917 A 10/1972 Foster
4,513,756 A 4/1985 Pittman et al.
4,528,993 A 7/1985 Sensabaugh, Jr et al.
4,607,479 A 4/1986 Linden
4,606,357 A 8/1986 Dusek et al.
4,624,269 A 11/1986 Story et al.
4,631,899 A 12/1986 Nielsen
4,802,498 A 2/1989 Ogren
4,821,749 A 4/1989 Toft et al.
4,975,270 A 12/1990 Kehoe
4,987,907 A 1/1991 Townend
4,991,599 A 2/1991 Tibbetts
5,092,352 A 3/1992 Sprinkle, III et al.
5,167,244 A 12/1992 Kjerstad
5,346,734 A 9/1994 Wydick, Jr.
5,387,416 A 2/1995 White et al.
5,405,561 A * 4/1995 Dais ..... B26D 9/00 156/204
5,543,164 A 8/1996 Krochta et al.
6,668,839 B2 12/2003 Williams
6,834,654 B2 12/2004 Williams
6,953,040 B2 10/2005 Atchley et al.
7,014,039 B2 3/2006 Henson et al.
7,032,601 B2 4/2006 Atchley et al.
7,537,110 B2 5/2009 Kutsch et al.
7,584,843 B2 9/2009 Kutsch et al.
7,694,686 B2 4/2010 Atchley et al.
7,798,319 B1 9/2010 Bried et al.
D625,178 S 10/2010 Bailey et al.
7,810,507 B2 10/2010 Dube et al.
7,819,124 B2 10/2010 Strickland et al.
7,861,728 B2 1/2011 Holton, Jr. et al.
7,946,296 B2 5/2011 Wrenn et al.
7,946,450 B2 5/2011 Gelardi et al.
8,033,425 B2 10/2011 Gelardi
8,048,466 B2 11/2011 McHugh et al.
9,084,439 B2 7/2015 Holton, Jr. et al.
2004/0020503 A1 2/2004 Williams
2004/0118421 A1 6/2004 Hodin et al.
2004/0118422 A1 6/2004 Lundin et al.
2004/0217024 A1 11/2004 Arnarp et al.
2005/0061339 A1 3/2005 Hansson et al.
2005/0115580 A1 6/2005 Quniter et al.
2005/0244521 A1 11/2005 Strickland et al.
2005/0252796 A1 11/2005 Sendo
2006/0118589 A1 6/2006 Arnarp et al.
2006/0191548 A1* 8/2006 Strickland ..... A24B 15/10 131/347
2007/0062549 A1 3/2007 Holton, Jr. et al.
2007/0261707 A1 11/2007 Winterson et al.
2008/0029110 A1 2/2008 Dube et al.
2008/0029116 A1 2/2008 Robinson et al.
2008/0029117 A1 2/2008 Mua et al.
2008/0173317 A1 7/2008 Robinson et al.
2008/0196730 A1 8/2008 Engstrom et al.
2008/0209586 A1 8/2008 Nielsen et al.
2008/0305216 A1 12/2008 Crawford et al.
2008/0317911 A1 12/2008 Schleef et al.
2009/0014343 A1 1/2009 Clark et al.
2009/0014450 A1 1/2009 Bjorkholm
2009/0025738 A1 1/2009 Mua et al.
2009/0047350 A1 2/2009 Bangalore
2009/0065013 A1 3/2009 Essen et al.
2009/0095313 A1 4/2009 Fuisz
2009/0230003 A1 9/2009 Thiellier
2009/0250360 A1 10/2009 Bellamah
2009/0293889 A1 12/2009 Kumar et al.
2010/0084424 A1 4/2010 Gelardi
2010/0133140 A1 6/2010 Bailey et al.
2010/0170522 A1 7/2010 Sun et al.
2010/0264157 A1 10/2010 Bailey et al.
2010/0211245 A1 11/2010 Gao et al.
2010/0300463 A1 12/2010 Chen et al.
2010/0300464 A1 12/2010 Gee et al.
2010/0303969 A1 12/2010 Sengupta et al.
2011/0061666 A1 3/2011 Dube et al.
2011/0083688 A1 4/2011 Mishra et al.
2011/0139164 A1 6/2011 Mua et al.
2011/0168712 A1 7/2011 Bailey et al.
2011/0180084 A1 7/2011 Sebastian et al.
2011/0204074 A1 8/2011 Gelardi et al.
2011/0247640 A1 10/2011 Beeson et al.
2011/0315154 A1 12/2011 Mua et al.
2012/0031414 A1 2/2012 Atchley et al.
2012/0031416 A1 2/2012 Atchley et al.
2012/0055493 A1 3/2012 Novak et al.
2012/0055494 A1 3/2012 Hunt et al.
2012/0118310 A1 5/2012 Cantrell et al.

FOREIGN PATENT DOCUMENTS

WO WO 2006/034450 3/2006
WO WO 2007/017761 2/2007
WO WO 2007/067953 6/2007
WO WO 2010/132444 11/2010
WO WO 2011/042211 4/2011
WO WO 2011/045010 4/2011

* cited by examiner

COMPOSITE TOBACCO-CONTAINING MATERIALS

CROSS-REFERENCE TO RELATED APPLICATIONS

This application is a division of U.S. application Ser. No. 13/530,145, filed on Jun. 22, 2012, which application is hereby incorporated by reference in its entirety in this application.

FIELD OF THE DISCLOSURE

The present invention relates to products made or derived from tobacco, or that otherwise incorporate tobacco, and are intended for human consumption. More particularly, the disclosure relates to film-encapsulated tobacco products adapted for oral consumption.

BACKGROUND OF THE DISCLOSURE

Tobacco may be enjoyed in a so-called "smokeless" form. Particularly popular smokeless tobacco products are employed by inserting some form of processed tobacco or tobacco-containing formulation into the mouth of the user. See, for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; and U.S. Pat. No. 7,946,296 to Wrenn et al.; US Pat. Pub. No. 2004/0020503 to Williams; US Pat. Pub. No. 2005/0115580 to Quinter et al.; US Pat. Pub. No. 2005/0244521 to Strickland et al.; US Pat. Pub. No. 2006/0191548 to Strickland et al.; US Pat. Pub. No. 2007/0062549 to Holton, Jr. et al.; US Pat. Pub. No. 2007/0261707 to Winterson et al.; US Pat. Pub. No. 2008/0029110 to Dube et al.; US Pat. Pub. No. 2008/0029116 to Robinson et al.; US Pat. Pub. No. 2008/0029117 to Mua et al.; US Pat. Pub. No. 2008/0173317 to Robinson et al.; US Pat. Pub. No. 2008/0196730 to Engstrom et al.; US Pat. Pub. No. 2008/0209586 to Neilsen et al.; US Pat. Pub. No. 2008/0305216 to Crawford et al.; US Pat. Pub. No. 2009/0065013 to Essen et al.; US Pat. Pub. No. 2009/0293889 to Kumar et al.; US Pat. Pub. No. 2010/0170522 to Sun et al.; US Pat. Pub. No. 2010/0291245 to Gao et al.; US Pat. Pub. No. 2010/0300463 to Chen et al.; US Pat. Pub. No. 2010/0300464 to Gee et al.; US Pat. Pub. No. 2010/0303969 to Sengupta et al.; US Pat. Pub. No. 2011/0061666 to Dube et al.; US Pat. Pub. No. 2011/0139164 to Mua et al.; US Pat. Pub. No. 2011/0247640 to Beeson et al.; Us Pat. Pub. No. 2011/0315154 to Mua et al.; US Pat. Pub. No. 2012/0031414 and US Pat. Pub. No. 2012/0031416 to Atchley et al.; US Pat. Pub. No. 2012/0055493 to Novak et al.; 2012/0055494 to Hunt et al.; US Pat. Pub. No. 2012/0118310 to Cantrell et al.; PCT Pub. No. WO 04/095959 to Arnarp et al.; and PCT Pub. No. WO 10/132444 to Atchley; each of which is incorporated herein by reference.

Representative smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

It would be desirable to provide an improved means for delivering compact or compressed amounts of smokeless tobacco wherein the means of delivery provides various advantageous features, such as ease of dispensing, use, and an overall enjoyable form.

BRIEF SUMMARY OF THE DISCLOSURE

The present invention provides tobacco products adapted for oral ingestion and processes for manufacturing the same. According to one aspect, a tobacco product adapted for oral consumption is provided that includes a tobacco composition and at least one edible film adapted for oral ingestion. The edible film includes one or more of (i) a fruit or vegetable puree and (ii) a denatured protein. The tobacco composition typically comprises at least one of a cut, ground, pelletized, particulate, granular, shredded, reconstituted, extruded, or cast tobacco material. According to one embodiment, the tobacco composition is in the form of a compressed tobacco sheet. According to another embodiment, the tobacco composition is enclosed in a pouch or bag, and the edible film is in contact with the pouch or bag. The edible film can be fibrillated or perforated. The edible film can further include at least one flavorant, flavor enhancer, sugar or other sweetener, souring agent, preservative, filler, pigment, or a combination thereof. According to one embodiment, the edible film includes a puree that includes at least about 75% of at least one fruit, vegetable, or combination thereof on a percent solids basis. According to one embodiment, the edible film can further include a film layer comprising an edible film-forming polymer, such as hydroxypropylmethylcellulose. Alternatively, the tobacco product can include at least two or more edible film or tobacco composition layers in a multi-layer structure.

According to another embodiment, a multi-layer tobacco product adapted for oral consumption, comprising a tobacco composition in the form of a compressed sheet layer; and at least one edible film adjacent to the tobacco composition layer, wherein the edible film comprises a puree of at least one fruit, vegetable, or a combination thereof, and wherein the film is adapted for oral ingestion. According to one embodiment, the film includes at least 75% of at least one fruit, vegetable, or combination thereof. The edible film can comprises a puree of a plant selected from the group consisting of green tea, coffee, wheatgrass, papaya, mangosteen, apple, peach, pear, strawberry, raspberry, cranberry, blueberry, mango, banana, cherry, apricot, rhubarb, guava, raisin, date, carrot, tomato, broccoli, bell pepper, pumpkin, kobocha, squash, corn, sweet potato, spinach, green bean, green pea, asparagus, and combinations thereof. According to one embodiment, the film can further include an edible plasticizer, an edible polymer, an edible insoluble fiber source, or a combination thereof. The film may be fibrillated or perforated. The film can further include at least one flavorant, flavor enhancer, sugar or other sweetener, souring agent, preservative, filler, pigment, or a combination thereof.

According to another aspect, a process for preparing a tobacco product adapted for oral consumption is provided. The process includes the steps of receiving a tobacco composition, receiving at least one edible film, applying the at least one edible film to the tobacco composition, and compressing the edible film and tobacco composition together to form a multi-layer tobacco product adapted for oral consumption. The edible film includes any of the edible films described herein, such as a film containing one or more of (i) a fruit or vegetable puree and (ii) a denatured protein. According to one embodiment, the tobacco composition is typically received as a cut, ground, pelletized, particulate, granular, shredded, reconstituted, extruded, or cast material. According to one embodiment, the tobacco composition is received as a compressed sheet material. According to one embodiment, the edible film is fibrillated or perforated prior to or after compressing the edible film and tobacco composition. The process may further include the step of heating the edible film prior to compressing the edible film and tobacco composition.

These and other features, aspects, and advantages of the disclosure will be apparent from a reading of the following detailed description together with the accompanying drawings, which are briefly described below.

BRIEF DESCRIPTION OF THE DRAWINGS

Figure 1:
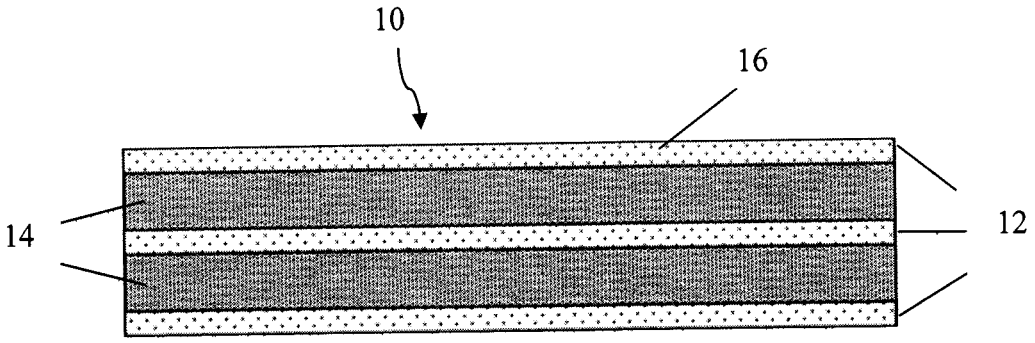
Figure 2:
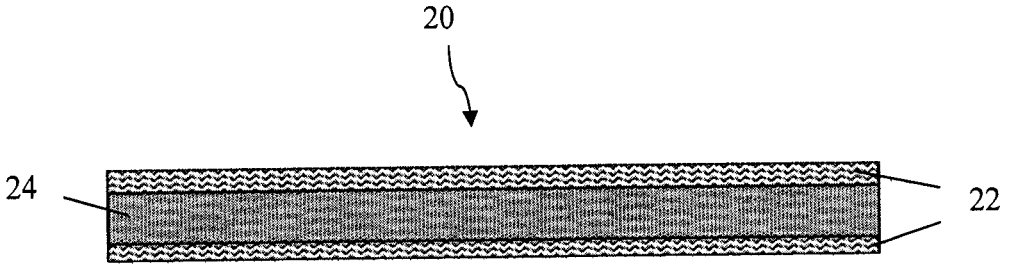
Figure 3:
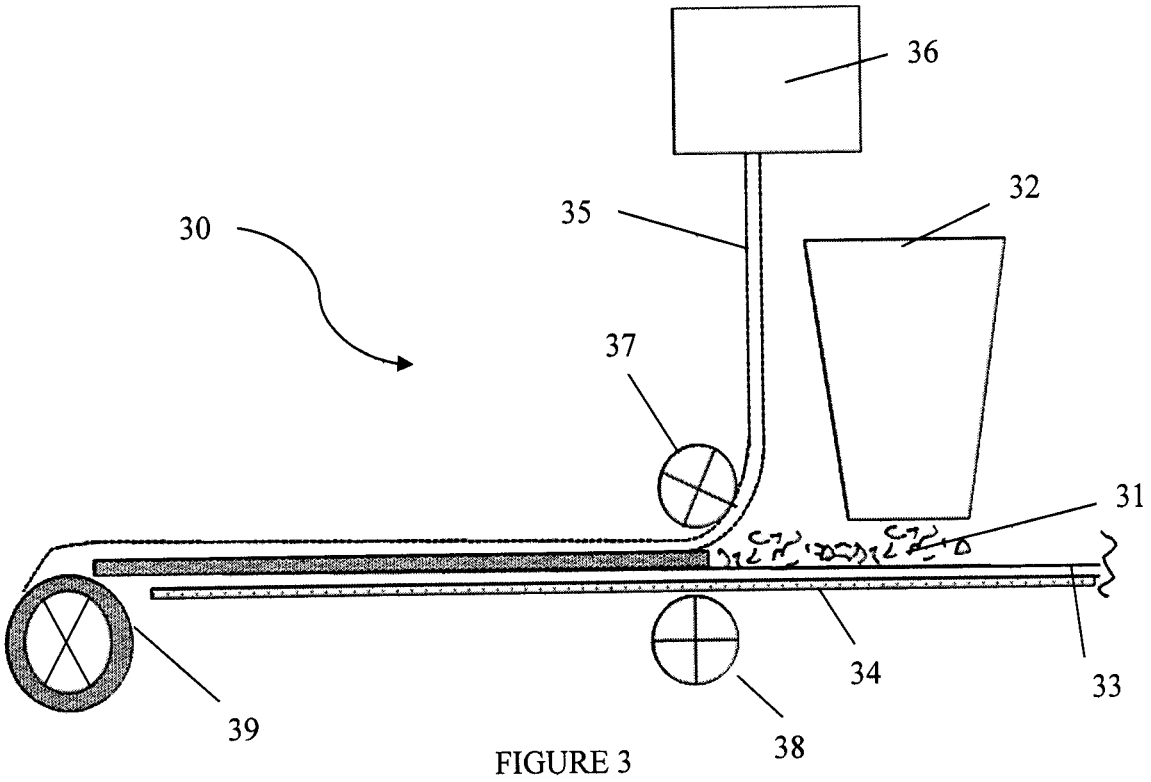
Figure 4:
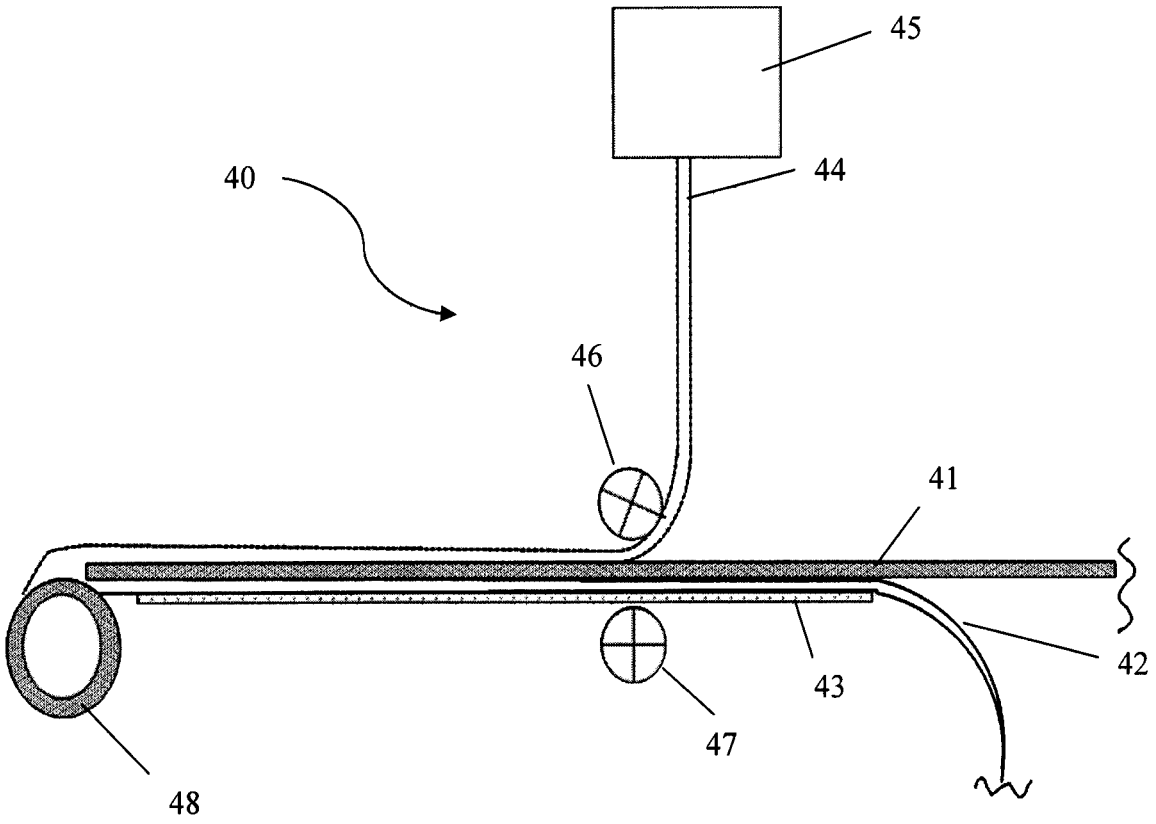
Figure 5:
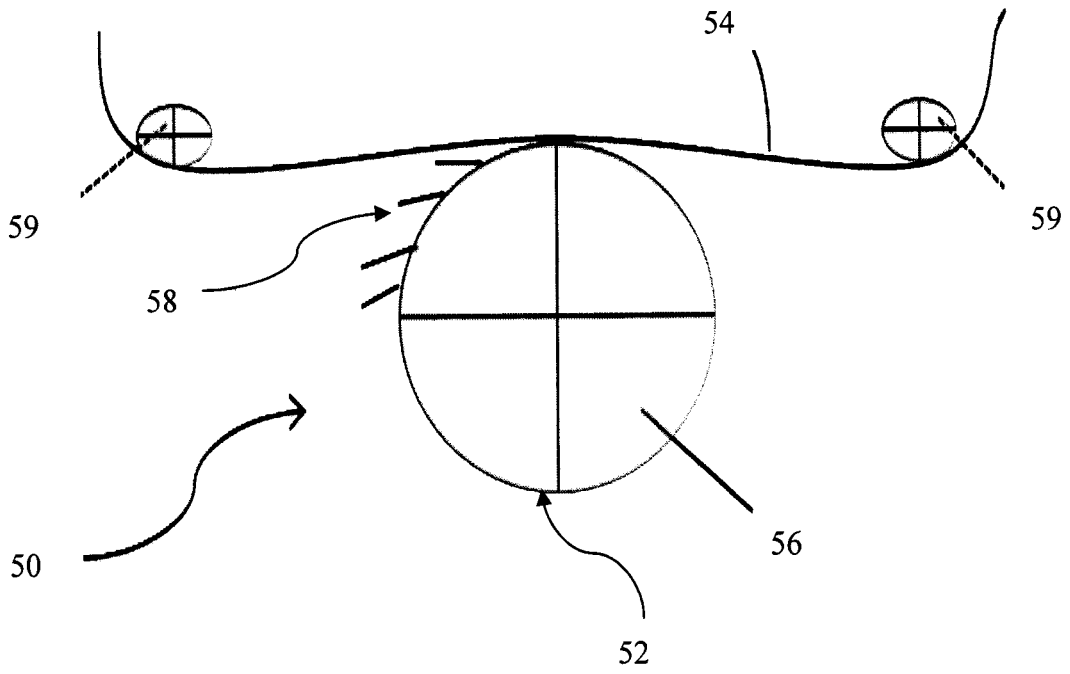
Figure 6:
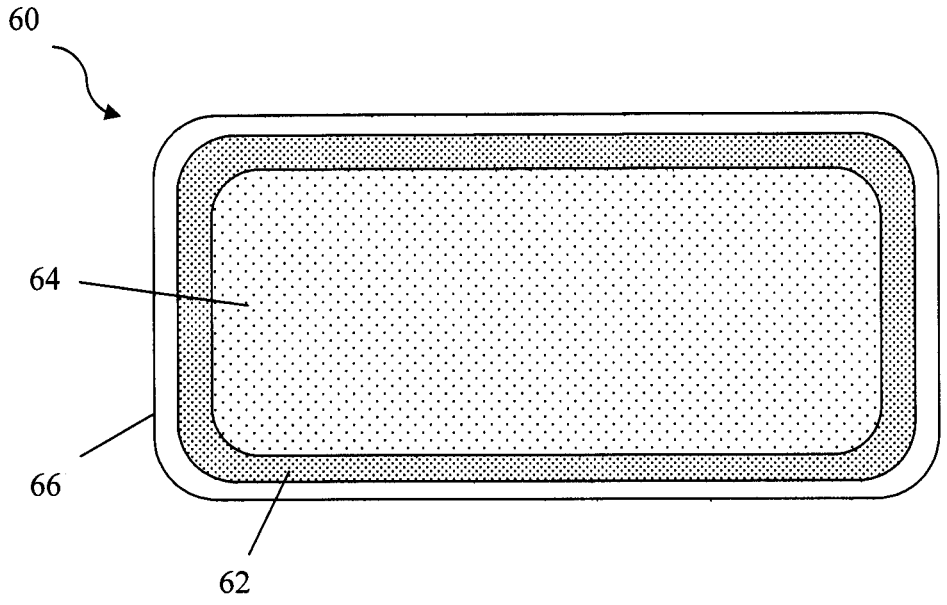

Having thus described the disclosure in general terms, reference will now be made to the accompanying drawings, which are not necessarily drawn to scale, and wherein:

FIG. 1 is a sectional view of an embodiment of a smokeless tobacco product of the present disclosure wherein at least one film is perforated;

FIG. 2 is a sectional view of an embodiment of a smokeless tobacco product of the present disclosure wherein at least one film is fibrillated;

FIG. 3 is a schematic of an apparatus for producing an encapsulated tobacco product wherein the tobacco is introduced as a loose composition prior to compression;

FIG. 4 is a schematic of an apparatus for producing an encapsulated tobacco product wherein the tobacco is introduced as a compressed sheet;

FIG. 5 is a schematic of a fibrillation unit for fibrillating a sheet of film material according to one aspect of the present disclosure; and FIG. 6 is a cross-sectional view of a smokeless tobacco product embodiment, taken across the width of the product, showing an edible film encapsulated outer pouch filled with a smokeless tobacco composition.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

A tobacco product adapted for oral consumption is provided. According to one embodiment, the tobacco product includes a tobacco composition and at least one film adapted to encapsulate the tobacco composition. The film is adapted for oral ingestion (i.e., edible) and may be manufactured from various edible materials such as polymers, fruits, vegetables, water-insoluble proteins, or combinations thereof.

As used herein, the term "tobacco composition" includes, but is not limited to, compositions comprising cut, ground, pelletized, particulate, granular, shredded, and reconstituted tobacco (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco products incorporating tobacco carried by a solid substrate (e.g., where substrate materials range from edible grains to inedible cellulosic sticks), extruded or formed tobacco-containing rods or sticks, compressed tobacco sheets, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like. Further, exemplary tobacco compositions include tobacco formulations in a loose form such as, for example, a moist snuff product. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. The tobacco composition used in the products of the invention can also include a tobacco extract, such as an aqueous tobacco extract. Such extracts can be used in liquid or solid form (e.g., freeze-dried or spray-dried form). Tobacco extracts used in the present invention can be treated (e.g., by ultrafiltration, microfiltration, nanofiltration, size exclusion chromatography, reverse osmosis, or combinations thereof) as described, for example, in U.S. patent application Ser. No. 13/240,525 to Holton Jr. et al., filed Sep. 22, 2011, which is incorporated herein by reference. Multiple types of tobacco composition can be used in the same product, such as combinations of a reconstituted tobacco or particulate tobacco with a tobacco extract.

If desired, the tobacco materials can be irradiated, pasteurized, or otherwise subjected to controlled heat treatment. Such treatment processes are detailed, for example, in US Pat. Pub. No. 2009/0025738 to Mua et al., which is incorporated herein by reference. A tobacco material (or a tobacco composition comprising a tobacco material) can be thermally treated by mixing the tobacco material (or composition thereof), water, and an additive selected from the group consisting of lysine, glycine, histidine, alanine, methionine, glutamic acid, aspartic acid, proline, phenylalanine, valine, arginine, di- and trivalent cations, asparaginase, saccharides, phenolic compounds, reducing agents, compounds having a free thiol group, oxidizing agents (e.g., hydrogen peroxide), oxidation catalysts, plant extracts, and combinations thereof, to form a moist tobacco mixture; and heating the moist tobacco mixture at a temperature of at least about 60° C. to form a heat-treated tobacco mixture. In one embodiment, the tobacco extract is heat treated in the presence of water, NaOH, and an additive (e.g., lysine) at about 88° C. for about 60 minutes. Such heat treatment can help prevent acrylamide production resulting from reaction of asparagine with reducing sugars in tobacco materials and can provide some degree of pasteurization. See, for example, US Pat. Pub. No. 2010/0300463 to Chen et al., which is incorporated herein by reference.

Further components can be admixed with, or otherwise incorporated within, the tobacco compositions according to the invention. The additional ingredients or components can be artificial, or can be obtained or derived from herbal or biological sources. Exemplary types of additional components include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring and titanium dioxide, and the like), humectants (e.g., glycerin, propylene glycol, and the like), oral care additives (e.g., thyme oil, eucalyptus oil, and zinc), preservatives (e.g., potassium sorbate, and the like), syrups (e.g., honey, high fructose corn syrup, and the like), disintegration aids (e.g., microcrystalline cellulose, croscarmellose sodium, crospovidone, sodium starch glycolate, pregelatinized corn starch, and the like), flavorant and flavoring mixtures (e.g., vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, eucalyptus, strawberry, or mixtures thereof), antioxidants, and mixtures thereof. If desired, the components can be microencapsulated as set forth in US Patent Appl. Pub. No. 2008/0029110 to Dube et al., which is incorporated by reference herein. In addition, exemplary encapsulated components are described, for example, in WO 2010/132444 A2 to Atchley, which has been previously incorporated by reference herein.

As used herein, the term "edible film" refers to a material capable of forming a film-like structure (e.g., a strip, sheet, or tape-like structure) suitable for encapsulation of a tobacco composition such as, for example, a smokeless tobacco composition, and which is suitable for human consumption. As used herein, the term "encapsulation" refers to the ability of the film to encompass, adhere to, or be applied on or around a tobacco composition, such as in the context of a multi-layer sheet structure. The edible film will not necessarily encapsulate all surfaces of a tobacco composition such that the edible film forms the entire outer surface of the product, although such structures are included in the invention. The edible film could simply be present as part of a multi-layer structure such that a significant portion of the outer surface of an adjacent tobacco composition layer is overlaid with the edible film, but the tobacco composition is still open to the outer surface of the product, such as at the lateral edges of a multi-layer product. The edible films disclosed herein add additional appeal to the tobacco product by adding nutrition, flavor, color, novelty, or a combination thereof. The edible films disclosed herein aid in the delivery of tobacco products which are convenient, fresh and flavorful. The edible films described herein are safe for oral ingestion (e.g., edible) such that once the film is in communication with a tobacco composition, the resulting tobacco product may be stored, packaged, and delivered to the end user for placement in the oral cavity. The various films disclosed herein can be used alone or in any combination with one another.

According to one embodiment, the edible film as described herein includes at least one layer of an edible film comprising at least one fruit, vegetable or a combination thereof, such as described in U.S. Pat. No. 8,048,466 to McHugh et al., which is incorporated herein by reference in its entirety. Such a film exhibits the thinness, strength, and flexibility to wrap around, encapsulate, bond or adhere to a tobacco composition such as, for example, a smokeless tobacco composition. According to one embodiment, an edible film layer comprising a fruit, a vegetable or a combination thereof may be used in addition to or in combination with one or more further edible film layers, which can be the same or different. According to one embodiment, the edible film contains at least about 75% (e.g., about 75% to about 100% fruit or vegetable puree) of at least one fruit, vegetable or combination of fruit and vegetable calculated on a percent solids basis of a total wet cast formulation.

The dry film thickness of the edible film may vary, but will typically be of sufficient thickness to provide rigidity, strength, and support to a loose or compressed tobacco composition and to remain intact upon introduction to a user's mouth. The thickness of the edible films can also depend on the desired rate of dissolution within the oral cavity, taste level, or mouth-feel. According to one embodiment, the edible films have a thickness from about 50 microns to about 1 millimeter.

The size of the fruit or vegetable particles in the edible film can vary, but is typically in the range of about 15 to about 1,700 micrometers. A more typical particle size is in the range of about 24 to about 1,000 micrometers.

According to one embodiment, the fruit component of the film may comprise one type of fruit alone or two or more types of fruit. Any fruit may be used including, but not limited to, apple, peach, pear, strawberry, raspberry, cranberry, blueberry, mango, banana, cherry, apricot, rhubarb, guava, raisin, papaya, mangosteen, and date. The vegetable component of the film may comprise one type of vegetable alone or two or more types of vegetables including, but not limited to, carrot, tomato, broccoli, bell pepper, pumpkin, kobocha (Asian pumpkin), squash, corn, sweet potato, spinach, green bean, green pea, and asparagus. For the purposes of this invention, the vegetable component can also be other plant material suitable for human consumption, for example, coffee, wheatgrass or green tea. The combination of fruit and vegetable components in the layer comprises one or more types of fruits and one or more types of vegetables as described above in any combination, mixture or blend of fruit and vegetable purees.

The fruit, vegetable or combination fruit and vegetable is prepared by first preparing a wet cast formulation. The fruit, vegetable, or combination fruit and vegetable component is provided as a puree. A fruit or vegetable puree refers to a paste or liquid suspension usually made by grinding a fruit or vegetable. The puree may be made from one type of fruit or vegetable alone, a blend or mixture of fruits, a blend or mixture of vegetables, or a combination, mixture or blend of fruit and vegetable purees. Other components may be included in the wet cast formulation in an amount sufficient to obtain a desired characteristic while maintaining the thinness, strength, flexibility, and crispness of the final film produced by the formulation. Without being limiting, examples of other components include edible plasticizer sources, edible polymers including soluble fiber sources, edible insoluble fiber sources, flavor ingredients or enhancers, and color sources or enhancers. Other suitable components may be added in an amount to provide flexibility, fiber, tensile strength, flavor, color or other advantageous properties. A commercially available embodiment of an edible film suitable for use in the present invention is available from NewGem Foods, LLC of Stockton, Calif.

According to one embodiment, the edible film can further include an edible polymer film. Such edible polymer films can be used, for example, as a part of a multi-layer edible film structure in combination with one or more additional edible films, such as one of the other film types disclosed herein (e.g., a denatured protein film or a vegetable/fruit puree-based film). An exemplary edible polymer film comprises hydroxypropylmethylcellulose (HPMC) such as that manufactured by Dow Chemical Company of Midland, Mich. under the trademark METHOCEL. According to another embodiment, the edible polymer film comprises polyanionic, polycationic and uncharged polymer species including synthetic cellulose polymers (e.g., hydroxy propyl cellulose (HPC), methyl cellulose (MC), carboxymethyl cellulose (CMC), hydroxyethyl cellulose, hydroxypropyl methyl cellulose, ethyl cellulose, and salts thereof), starches, and natural cellulose polymers such as acacia, tragakanth, carrageenan, pullulan and other water soluble polymers including polystyrene sulfonates, polyethylene oxides/polyethylene glycols, polyacrylic acids, polybenzenesulfonic acids, polyethylenimine, poly diallyldimethyl ammonium chloride, polyallylamine hydrochloride, polyvinyl pyrrolidone (PVP), water soluble polymeric materials such as pectin and derivatives thereof, guar gum, xanthan gum, gellan sodium salt, propyleneglycol alginate, starches (amylose, amylopectin), modified starches, hydroxyethyl starch, pullulan, carboxymethyl starch, gum ghatti, okra gum, karaya gum, dextrans, dextrins and maltodextrins, konjac, acemannan from aloe, locust bean gum, tara gum, quince seed gum, fenugreek seed gum, scleroglucan, gum arabic, psyllium seed gum, tamarind gum, oat gum, quince seed gum, carrageenans, scleraglucan, succinoglucan, larch arabinogalactan, flaxseed gum, chondroitin sulfates, hyaluronic acid, curdlan, chitosan, deacetylated konjac, rhizobium gum, a water soluble polypeptide or protein such as gelatin, albumin, milk protein, soy protein, whey protein, low molecular weight polyacrylamides and their sodium salts (carbomers), polyethylene glycols, polyvinyl alcohols, pluronics, tetronics, and other block co-polymers, carboxyvinyl polymers, and colloidal silicon dioxide, or mixtures of the foregoing. Other ingredients may be included, for example, solubilizing agents, suspending agents, emulsifiers, plasticizers, taste modifying flavorants, water soluble/dispersible/suspendable inert fillers, preservatives, buffering agents, coloring agents, permeation enhancers, or a stabilizer may also be included in the edible polymer film.

Edible polymer films can be prepared by dissolution or dispersion of the film forming material either in water or a suitable organic solvent or a mixture thereof. To the resulting polymer solution mix, any additional components or additives disclosed herein are added and combined in any order in a vessel equipped with heating mechanism such as steam jacket and a mechanical mixing device. The resultant mixture can then be applied onto a backing film using a known coating mechanism such as a doctor knife or reverse roll coating. The coated backing film can then be passed through a drying chamber assembly where the heated air at predetermined temperatures is blown on to the film to remove any excess water or solvent.

According to another embodiment, the film as described herein is an edible water-insoluble protein-based film, such as those described in U.S. Pat. No. 5,543,164 to Krochta et al., which is incorporated herein by reference in its entirety. The edible water-insoluble protein-based film typically exhibits superior barrier properties to water, oxygen, carbon dioxide, lipids, flavors and aromas within the environment that can be detrimental to the freshness of a tobacco composition. According to one embodiment, the proteins of the protein-based film include isolated proteins having cysteine and/or cysteine residues, which are capable of undergoing thiol-disulfide interchange reactions and/or thiol oxidation reactions. Preferably, the proteins are substantially free of any sugars. According to one embodiment, the proteins are those which are isolated from milk, wheat, soy, egg, or corn.

A protein-based film may be prepared by first treating an aqueous solution of a protein, in which the protein is typically present in an amount of from 5 to 20% by weight, to effect disulfide formation in the protein to form a denatured protein solution. The denatured protein solution is then dried to form a film. A food grade plasticizer may be optionally added to the denatured protein solution. The food grade plasticizer is added to the denatured solution along with a lipid component. The food grade plasticizer serves to increase both the mechanical strength of the film and its flexibility. The plasticizer is preferably a polyalcohol, for example, sorbitol, glycerol or polyethylene glycol.

The films described herein may optionally include one or more flavorants or flavor enhancers including, but are not limited to peppermint, spearmint, wintergreen, menthol, cinnamon, chocolate, vanillin, licorice, clove, anise, sandalwood, geranium, rose oil, vanilla, lemon oil, cassia, fennel, ginger, ethylacetate, isoamylacetate, propylisobutyrate, isobutylbutyrate, ethylbutyrate, ethylvalerate, benzylformate, limonene, cymene, pinene, linalool, geraniol, citronellol, citral, orange oil, coriander oil, borneol, fruit extract or combinations thereof. The film described herein may optionally include one or more sugars or other sweeteners including, but not limited to, monosaccharides (e.g., fructose, glucose, xylose, etc.), disaccharides (e.g., sucrose, trehalose, lactose, etc.), trisaccharides, polysaccharides, oligosaccharides (e.g., fructan and inulins), sugar alcohols (e.g., sorbitol, xylitol, lactitol, maltitol, etc.), and mixtures of sugars (e.g., combinations of honey, corn syrups, light corn syrups and/or high fructose corn syrups, etc.). In addition, or in the alternative to sweeteners, the film described herein can optionally include one or more souring agents such as acetic acid, adipic acid, citric acid, lactic acid, malic acid, succinic acid, tartaric acid, or combinations thereof. The film described herein may optionally include one or more preservatives including, but are not limited to, acetic acid, benzoic acid, citric acid, lactic acid, malic acid, sorbic acid, tartaric acid, or combinations thereof. The film described herein may optionally include one or more fillers including, but are not limited to, cellulose, titanium oxide, magnesium silicate (e.g., talc), aluminum silicate, magnesium carbonate, calcium carbonate (e.g., limestone), calcium phosphate, calcium sulfate, zinc oxide, aluminum oxide, or combinations thereof. The film described herein may optionally include one or more pigments (e.g., coloring agents) in an amount sufficient to impart a desired color or color pattern to the film. The film described herein may optionally include one or more additives including, but not limited to, amino acids, antioxidants, food grade emulsifiers, pH modifiers, or combinations thereof.

The above types of films may be combined in the same product, meaning products of the invention could include both a fruit/vegetable puree film layer and a denatured protein film layer. Additionally, individual film layers could comprise a mixture of two or more film types within the same layer, such as a mixture of a fruit/vegetable puree and a denatured protein film layer.

FIG. 1 provides a sectional view of an embodiment of a smokeless tobacco product 10 of the present disclosure. As illustrated, the tobacco product 10 includes three edible film layers 12 that encapsulate two tobacco composition layers 14. One or more of the film layers 12 may include at least one perforation 16, and typically will include a plurality of perforations. The perforations aid in entanglement of the tobacco composition with the edible film, which can result in better inter-layer adhesion and a more structurally stable smokeless tobacco product. The number of layers of the product can vary, and the illustrated embodiment is merely exemplary. In other embodiments, the product of the invention includes only one layer of edible film and one layer of tobacco composition, or two layers of edible film encapsulating a single tobacco composition layer.

FIG. 2 provides a sectional view of an alternative embodiment of a smokeless tobacco product 20 of the present disclosure. As illustrated, the tobacco product 20 includes two edible film layers 22 that encapsulate a tobacco composition 24. One or more of the edible film layers 22 may include a fibrillated surface 16. The fibrillated surface aids in entanglement of the tobacco composition with the film, which again leads to better inter-layer adhesion and a more structurally stable smokeless tobacco product. Again, the number of layers shown is merely exemplary, and any number of edible film and tobacco composition layers can be employed.

A multi-layer product of the present invention may be prepared by a variety of processes including mixing, casting and drying processes and equipment known in the art. Referring to FIG. 3 and FIG. 4, the edible films may be combined with (e.g., encompass, adhere to, encapsulate, or be applied on, around or between) a tobacco composition by various mechanical processes. According to FIG. 3, an apparatus 30 is used to encompass or encapsulate a tobacco composition within an edible film as described herein. A loose tobacco composition 31 is deposited from a hopper 32 onto a first edible film 33 that is moved along a carrier surface 34 (e.g., a moving web or belt). Simultaneously, a second film 35 is fed onto the loose tobacco composition 31. The second edible film 35 may be fed from a film modification unit 36 whereby the second film 35 is optionally perforated or fibrillated prior to application on the tobacco composition 31. Thus, as illustrated, the second film 35 is optionally modified with one or more perforations or fibrillations, however, it is within the scope of the invention to have a first film 33 that is perforated or fibrillated such that either of the first film 33 or second film 35 is modified or both the first film 33 and second film 35 are modified via one or more perforations or fibrillations. The first film 33, loose tobacco composition 31, and second film 35 are then compacted or compressed by a nip which comprises a first roller 37 and second roller 38. The first film 33 or the second film 35 or both the first film 33 and second film 35 are optionally heated to soften the first film 33 or second film 35 prior to compression. Heat may be applied via heated rollers (37, 38), infrared, ultrasonic, microwave or other suitable heating means. In an alternative embodiment, the film modification unit 36 may be located after the nip such that on-line perforation or fibrillation occurs after formation of the tobacco product.

Once compressed, the resulting material can be collected onto a roll 39 for storage. Alternatively, the roll 39 is reintroduced to the device for introduction of one or more additional layers of tobacco composition or edible film or both tobacco composition and edible film. The resulting multi-layer product can be subdivided into individual product units as desired.

FIG. 4 illustrates an alternative apparatus 40 for producing an encapsulated tobacco product. A compressed tobacco composition sheet 41 is applied to a first edible film 42 which is moved along a carrier surface 43. A second edible film 44 is fed onto the compressed tobacco composition 41. The second film 44 may be fed from a film modification unit 45 whereby the second film 44 is optionally perforated or fibrillated prior to application on the tobacco composition 41. Thus, as illustrated, the second film 44 is optionally modified with one or more perforations or fibrillations, however, it is within the scope of the invention to have a first film 42 that is perforated or fibrillated such that either of the first film 42 or second film 44 is modified or both the first film 42 and second film 44 are modified via one or more perforations or fibrillations. The first film 42, compressed tobacco composition 41, and second film 44 are then compacted or compressed by a nip which comprises a first roller 46 and second roller 47. The first film 42 or the second film 44 or both the first film 42 and second film 44 are optionally heated to soften the first film 42 or second film 44 prior to compression. Heat may be applied via heated rollers (46, 47), infrared, ultrasonic, microwave or other suitable heating means. In an alternative embodiment, the film modification unit 45 may be located after the nip such that on-line perforation or fibrillation occurs after formation of the tobacco product. In an alternative process, the edible film (or multiple edible films) and the tobacco sheet (or multiple tobacco sheets) can be co-extruded to form the multi-layer laminate structure.

Once compressed, the resulting material is spun onto a roll 48 for storage. Alternatively, the roll 48 is reintroduced to the device for introduction of one or more additional layers of compressed tobacco composition or edible film or both compressed tobacco composition and film. The resulting multi-layer product can be subdivided into individual product units as desired.

The compressed tobacco composition as illustrated in FIG. 4 may be manufactured by a direct compression process or by a granulation process prior to introduction to the apparatus 40. The direct compression process includes a blending and processing step which may be conducted by first forming a tobacco blend. As indicated above, the tobacco may comprise a blend of various types, shapes, sizes, and cuts, or a single variety of the aforementioned tobaccos may be used instead of a blend. The tobacco may be cured or uncured. Next, the tobacco blend is further processed through the use of a grinding step. The ground tobacco will typically have an average particle size of less than about 1 mm. After grinding, the tobacco component can be optionally cooked (semi-pasteurized) by any suitable technique. For example, the tobacco component can be cooked by high pressure, heat and/or steam. Other cooking techniques can also be used. Following cooking, the tobacco component may be stored at or about room temperature until needed for further processing.

As noted herein, the film of the present invention can include one or more perforations. The perforations may be of any size and shape and may be present in any number within the film body. The perforations can be in various directions and designs. According to one embodiment, the one or more perforations extends to a depth such that the tobacco composition which the film surrounds is in direct contact with the users gum or cheek upon introduction of the tobacco product to the user's oral cavity.

The perforations may be introduced to the films disclosed herein by various mechanisms including ultrasonic, mechanical drilling/punching, burning with pins or hot needles, laser, or high energy perforation. According to one embodiment, an ultrasonic means is used to simultaneously introduce perforations and heat the film. According to another embodiment, perforations are formed by applying the film forming material to a protruded base film surface which is subsequently peeled away to provide holes in the films, such as described in US Pat. Pub. No. 2009/0047350 to Bangalore, which is incorporated herein by reference in its entirety. Following perforation, the film can then cut into appropriate dimensions and packaged or stacked in a dispensing container. According to one embodiment, the perforations are made in films of various thicknesses. The thickness of the film forms a basis for the number of perforations in the film leading to dispersion and dissolution of the films in the oral cavity.

The film of the present invention may include one or more fibrillations (e.g., wave-like surface feature). According to one embodiment, the film is first formed according to known methods or the methods provided herein. According to one embodiment, the film may be subjected to mechanical fibrillation by conventional means to produce a wavy surface on the exterior face the film. FIG. 5 illustrates a fibrillation unit 50 according to one embodiment. As illustrated, the fibrillation unit 50 may comprise a fibrillation roller assembly 52 configured to interact with a film 54 so as to fibrillate the film, such as described in US Pub. No. 2011/0180084 to Sebastian et al., which is incorporated herein by reference in its entirety. In one instance, the fibrillation roller assembly 52 may include a fibrillating roller member 56 which is generally configured as a cylinder. A plurality of fibrillating pins or needle-like members, generally designated as 58, extend outwardly from an outer surface or periphery of the fibrillating roller member 56, and the pins or needle-like members 58 are configured to cut or otherwise slit the film 54 as the film passes over or otherwise engages the fibrillating roller member 56. During the fibrillation process, the film 54 is fed to the fibrillation unit 50 and appropriately directed and positioned by one or more guide rollers 59 for interaction with the fibrillating pins 58. The guide rollers 59 may be positioned adjacent to the fibrillating roller member 56 to provide guidance/tension for the film 54. The fibrillating roller member 56 may be configured to rotate in the direction in which the film 54 is moving or otherwise directed, such that the fibrillating pins 58 interact with the film 54 in the same direction. The circumferential or angular speed of the fibrillating roller member 56 may be approximately 15-30% higher than the speed at which the film 54 advances in the machine direction. However, one skilled in the art will appreciate that such parameters may vary, as necessary or desired to achieve the fibrillated film as disclosed herein.

The resulting multi-layer tobacco product may be subject to further processing to cut or mold the rolled tobacco product into a variety of shapes or forms suitable for consumer use. Thus, the resulting tobacco products can be processed to an acceptable size and shape to be placed in the mouth and consumed orally. Suitable shapes include squares, rectangles, round, oval, triangular, trapezoidal or any other shape suitable for placement between the cheek and gum. Alternatively, the tobacco product may be delivered in a continuous rolled form such that the end user may tear off or cut an acceptable length for use.

According to one embodiment, the films as described herein may encapsulate individual tobacco composition units that are contained within an existing pouch or bag. Such products include the type commonly used for the manufacture of snus types of products (e.g., a sealed, moisture permeable pouch that is sometimes referred to as a "portion"). A representative moisture permeable pouch can be composed of a "fleece" type of material. The tobacco composition is in turn contained within a package that is sealed tightly, and is composed of a suitable material, such that the atmospheric conditions within that sealed package are modified and/or controlled. Descriptions of various components of snus products and components thereof also are set forth in US Pat. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and US Pat. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmBH. G.D SpA out of Italy also supplies tobacco pouching equipment. Snus pouches can be provided as individual pouches, or a plurality of pouches and can be connected or linked together (e.g., in an end-to-end manner) such that a single pouch or individual portion can be readily removed for use from a one-piece strand or matrix of pouches.

Referring to FIG. 6, a representative snus type of tobacco product comprising an edible film of the current disclosure is shown. In particular, FIG. 6 illustrates a smokeless tobacco product 60 having a pouch 62 containing a smokeless tobacco composition 64. The pouch 62 is further encapsulated in an edible film 66 of the present disclosure. Although not shown, the pouch 62 may be encapsulated in more than one film 66 or film layer. The edible film 66 can also be placed in contact with the inner surface of the pouch if desired, or simply mixed in particulate or shredded form with the tobacco composition within the pouch.

Exemplary smokeless tobacco compositions capable of use with the present disclosure are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. Pat. No. 7,810,507 to Dube et al.; U.S. Pat. No. 7,819,124 to Strickland et al.; U.S. Patent Pub. No. 2005/0244521 to Strickland et al.; U.S. Patent Pub. No. 2006/0191548 to Strickland et al.; and U.S. Patent Pub. No. 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco compositions are set forth in US Patent Pub. Nos. 2004/0217024 and 2006/0118589 to Arnarp et al.; and 2009/0014450 to Bjorkholm; and PCT Pub. Nos. WO 2006/034450 to Budd; WO 2007/017761 to Kutsch et al.; and WO 2007/067953 to Sheveley et al. All of the above-cited references are incorporated by reference herein in their entirety.

Products of the present invention may be packaged and stored in any suitable packaging. See, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 7,946,450 to Gelardi et al.; U.S. Pat. No. 8,033,425 to Gelardi; U.S. Pat. No. 8,066,123 to Gelardi; D592,956 to Thiellier; D594,154 to Patel et al.; and D625,178 to Bailey et al.; US Pat. Pub. No. 2008/0173317 to Robinson et al.; US Pat. Pub. No. 2009/0014343 to Clark et al.; US Pat. Pub. No. 2009/0014450 to Bjorkholm; US Pat. Pub. No. 2009/0250360 to Bellamah et al.; US Pat. Pub. No. 2009/0230003 to Thiellier; US Pat. Pub. No. 2010/0084424 to Gelardi; US Pat. Pub. No. 2010/0133140 to Bailey et al; US Pat. Pub. No. 2010/0264157 to Bailey et al.; US Pat. Pub. No. 2011/0168712 to Gelardi et al.; and US Pat. Pub. No. 2011/0204074 to Bailey et al., which are incorporated herein by reference.

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A process for preparing a tobacco product adapted for oral consumption, comprising receiving a tobacco composition;

receiving at least one edible film;

applying the at least one edible film to the tobacco composition; and compressing the edible film and tobacco composition together to form a multi-layer tobacco product adapted for oral consumption, wherein the edible film comprises one or more of (i) a fruit or vegetable puree and (ii) a denatured protein, wherein the edible film is perforated, and optionally fibrillated, prior to or after compressing the edible film and tobacco composition, and wherein perforations in the edible film extend to a depth such that at least a portion of the composition is exposed on a surface of the multi-layer tobacco product and capable of direct contact with an oral cavity of a user upon introduction into the oral cavity.

2. The process of claim 1, wherein the tobacco composition is received as a cut, ground, pelletized, particulate, granular, shredded, reconstituted, extruded, or cast tobacco material.

3. The process of claim 1, wherein the tobacco composition is received as a compressed tobacco sheet.

4. The process of claim 1, further comprising the step of heating the edible film prior to compressing the edible film and tobacco composition.

5. The process of claim 1, wherein the edible film comprises at least about 75% of the fruit or vegetable puree on a percent solids basis.

6. A process for preparing a product adapted for oral consumption, comprising receiving a composition comprising a tobacco extract carried by a solid substrate;

receiving an edible film;

applying the edible film to the composition; and compressing the edible film and composition together to form a multi-layer tobacco product adapted for oral consumption, wherein the edible film comprises one or more of (i) a fruit or vegetable puree and (ii) a denatured protein, and wherein the edible film is perforated, and optionally fibrillated, prior to or after compressing the edible film and tobacco composition, and wherein perforations in the edible film extend to a depth such that at least a portion of the composition is exposed on a surface of the multi-layer tobacco product and capable of direct contact with an oral cavity of a user upon introduction into the oral cavity.

7. The process of claim 6, wherein the composition is received as an extruded or cast material.

8. The process of claim 6, wherein the composition is received as a compressed sheet.

9. The process of claim 6, comprising fibrillating the edible film by advancing the edible film in a machine direction past a fibrillating roller comprising a plurality of pins configured to engage the edible film.

10. The process of claim 9, wherein the angular speed of the fibrillating roller is about 15-30% higher than the speed at which the edible film advances in the machine direction.

11. The process of claim 6, comprising perforating the edible film and heating the film simultaneously using an ultrasonic energy source.

12. The process of claim 6, further comprising heating the edible film prior to compressing the edible film and composition.

13. The process of claim 6, wherein the edible film layer comprises an edible film-forming polymer adapted for oral ingestion.

14. The process of claim 13, wherein the edible film-forming polymer is hydroxypropylmethylcellulose.

15. The process of claim 6, wherein the solid substrate comprises one or more grains or one or more cellulosic materials.

16. The process of claim 6, wherein the tobacco extract comprises an aqueous tobacco extract.

17. The process of claim 6, wherein the composition further comprises at least one additive selected from the group consisting of salts, fillers, sweeteners, pH adjusters, buffering agents, colorants, humectants, flavorants, and combinations thereof.

18. The process of claim 6, wherein the composition comprises at least one additive from an herbal source.

19. The process of claim 6, wherein the edible film encapsulates all surfaces of the composition such that the edible film forms the entire outer surface of the product.

20. The process of claim 6, further comprising:

receiving a second edible film layer, wherein the edible film layer and the second edible film layer each comprise an edible film-forming polymer adapted for oral ingestion; and positioning each of the edible film layer and the second edible film layer overlying an opposing surface of the composition and adjacent to the composition such that the composition is substantially encapsulated by the edible film layer and the second edible film layer.

21. The process of claim 6, wherein the edible film comprises a fruit or vegetable puree having a particle size of about 24 to about 1000 μm.

22. The process of claim 6, wherein the edible film comprises a denatured protein having cysteine and/or cysteine residues.

23. The process of claim 6, further comprising subdividing the multi-layer tobacco product into individual product units.

* * * * *